United States Patent [19]

Ossner

[11] Patent Number: 4,587,754

[45] Date of Patent: May 13, 1986

[54] ILLUMINATED DISPLAY DEVICES

[76] Inventor: Martin W. G. Ossner, No. 8 Dolphin St., Randwick, New South Wales, 2031, Australia

[21] Appl. No.: 592,421

[22] Filed: Mar. 21, 1984

[30] Foreign Application Priority Data

Mar. 29, 1983 [AU] Australia ..... PF8671

[51] Int. Cl.[4] ..... G09F 13/04

[52] U.S. Cl. ..... 40/564; 40/575; 40/573; 362/260; 362/311

[58] Field of Search ..... 40/605, 564, 541, 545, 40/551, 571, 573, 577, 578; 362/311, 260, 217, 219, 222, 223, 224, 225, 226, 97, 33; 340/115, 84

[56] References Cited

U.S. PATENT DOCUMENTS

| | | | |
|---|---|---|---|
| 1,338,532 | 4/1920 | Root | 40/573 |
| 1,385,236 | 7/1921 | Williams | 40/575 |
| 1,448,625 | 3/1923 | Hammack et al. | 40/573 |
| 3,218,446 | 11/1965 | Langer | 362/260 |
| 3,321,731 | 5/1967 | Goldbaum | 340/115 |
| 3,500,569 | 3/1970 | Simmons | 40/564 |
| 3,680,238 | 8/1972 | Arnold | 40/564 |
| 3,737,654 | 6/1973 | Hawley | 362/311 |
| 3,745,327 | 7/1973 | Lowery et al. | 362/311 |
| 3,829,999 | 8/1974 | Bernstein | 40/564 |
| 3,837,105 | 9/1974 | Tchakgarian | 40/541 |
| 4,277,904 | 7/1981 | Leuthesser | 40/564 |
| 4,447,802 | 5/1984 | Böse | 40/605 |

FOREIGN PATENT DOCUMENTS

| | | | |
|---|---|---|---|
| 463092 | 2/1914 | France | 40/573 |
| 65638 | 7/1913 | Switzerland | 40/573 |

*Primary Examiner*—Gene Mancene
*Assistant Examiner*—James Hakomaki
*Attorney, Agent, or Firm*—Hamilton, Brook, Smith & Reynolds

[57] ABSTRACT

An illuminated display consists in a number of light box modules (11) each having a casing (12,13,14,15,16) and a light source within the casing for illuminating a transparency (23). Each module (11) is adapted for mounting to a skeletal support frame (7) in contiguous relationship with another. Preferably the module casing has sidewalls which on at least 3 sides include an inward step (14) adapted to engage members (7) of the frame.

8 Claims, 6 Drawing Figures

FIG. 1
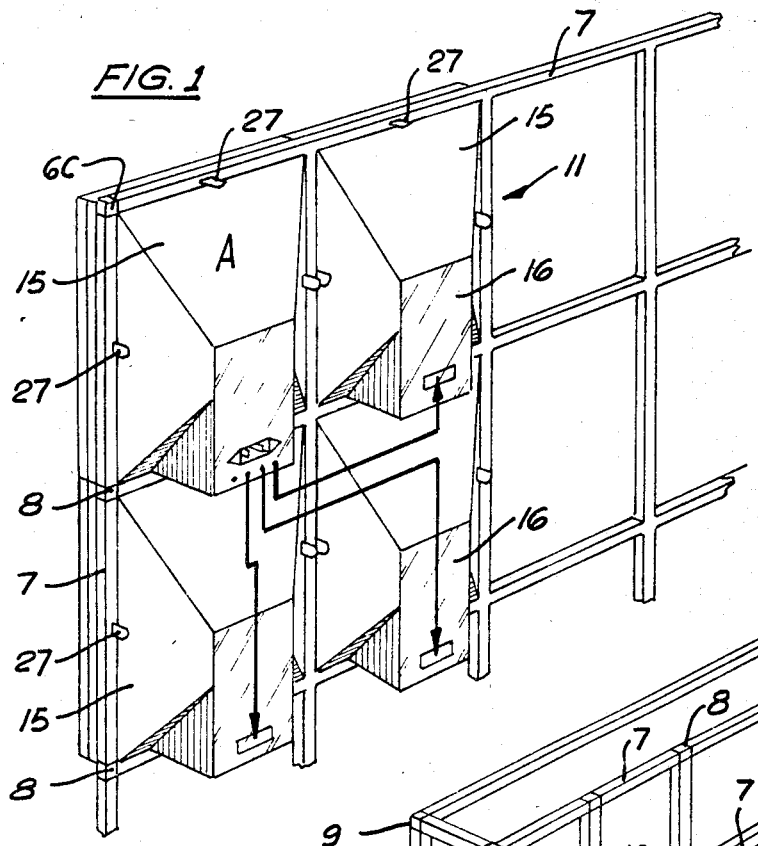
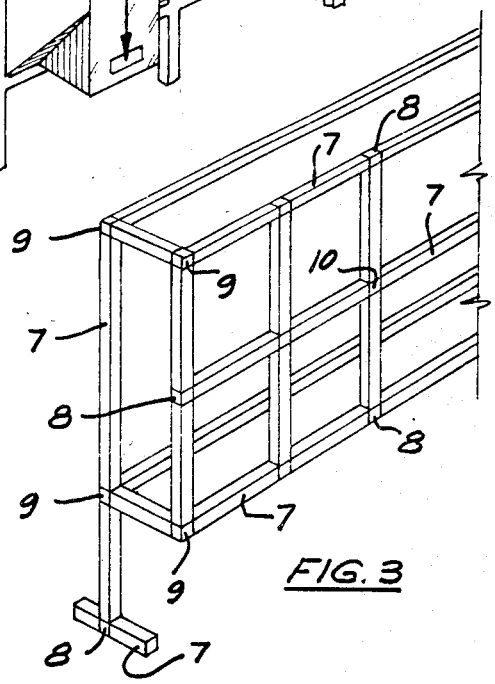
FIG. 3
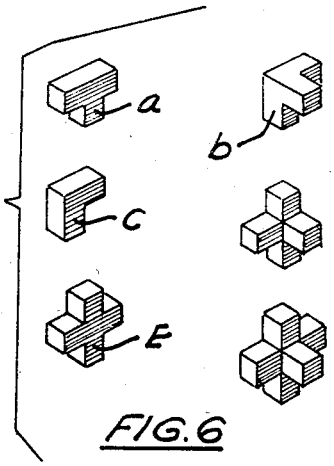
FIG. 6

ILLUMINATED DISPLAY DEVICES

FIELD OF USE

This invention relates to apparatus for use for providing an illuminated display and to a method of manufacture of an illuminated display.

BACKGROUND OF THE INVENTION

Light boxes providing strong uniform illumination for viewing photgrahic transparencies and the like are well known and typically consist of a rectangular box containing a light source and provided on one face with a window of translucent glass which acts as a light diffuser and on which transparencies to be viewed may be placed.

It is also known to provide display units which consist in a light-box aontaining a light source and having a single photographic transparency or the like mounted between the light source and viewers; the transparencies being illuminated for viewing by transmitted light. Sometimes a plurality of transparencies are mounted so as to be illuminated from the light source or sources within the light box. In large displays of this type one or more light sources may be housed within the box and a plurality of windows may be provided on the display face each window having a transparency. Commonly the windows are spaced one from another by a window frame.

In such cases the light box is typically individually manufactured having regard to the size of transparencies to be displayed, the display arrangement desired and the overall size of the display required.

An object of the present invention is to provide a modular system whereby an illuminated display may be assembled from a relatively small number of part types to provide a large variety of display area dimensions and configurations.

DISCLOSURE OF THE INVENTION

According to one aspect the invention consists in an illuminated display comprising a plurality of light box modules; each module including a casing, a light source within the casing and having means for mounting a transparency to be displayed by light transmitted from said source through the transparency, each module being adapted for mounting to a skeletal support frame in contiguous relationship with a like light box module.

In preferred embodiments of the invention each module is provided with means for mounting a transparency so that the transparency displayed by one module appears to be substantially contiguous with a transparency displayed by a contiguous module. This enables a picture having a large area (for example 120×120 cm) to be composed from transparencies each of a small area, for example 4 transparencies each of 30×30 cm without it being obvious that the composition is a montage.

In a preferred embodiment each module is adapted for clip mounting and the display area may be extended in two dimensions of a plane or in three dimensions for example on the surface of a cube. Means are provided whereby the modules may readily be dismounted from the framework and reassembled therewith in a different configuration and the transparencies may be changed without de-mounting modules from the supporting frame.

An embodiment of the invention is illustrated, by way of example only, in the drawings herewith.

DESCRIPTION OF THE DRAWINGS

FIG. 1 shows a support frame suitable for the support of two horizontal rows of display units.

FIG. 3 shows a support frame of different form from that of FIG. 1.

FIGS. 6A–6F show six forms of a corner or junction piece.

BEST MODE OF CARRYING OUT THE INVENTION

Figure 2:
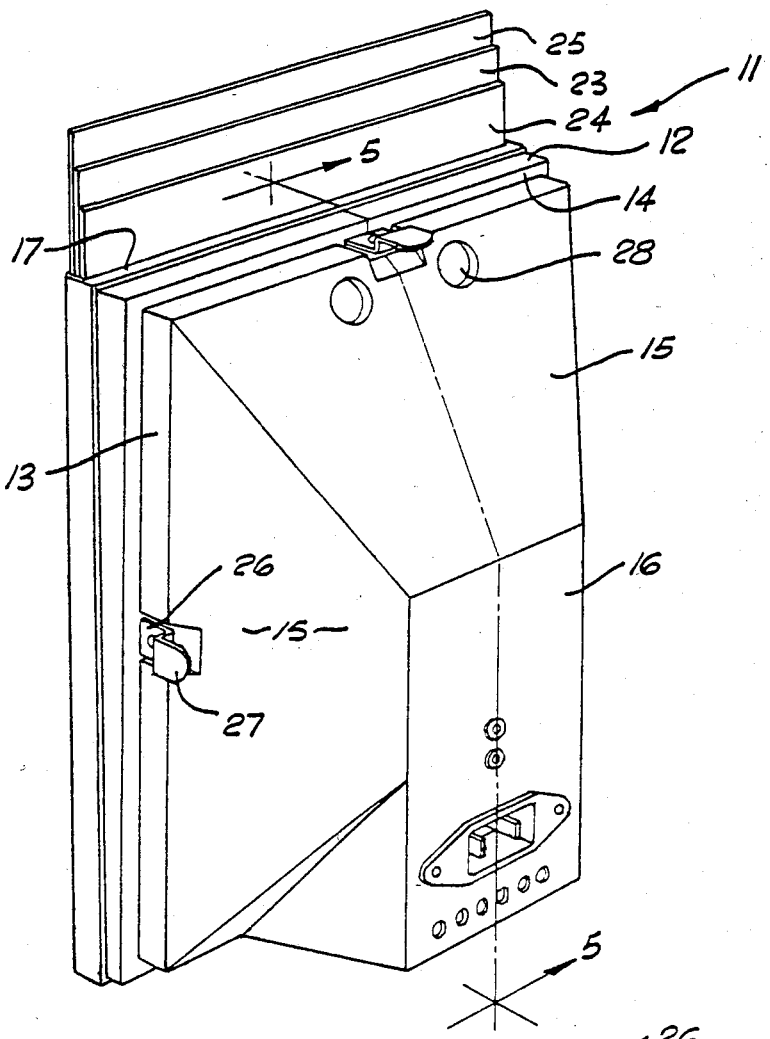
FIG. 2 shows, in greater detail, one of the display units shown in FIG. 1.

With reference to FIGS. 1 and 3 there are shown support frames for mounting light box modules. Each consists of a plurality of straight tubular portions 7 of square cross section adjoined by one of the junction pieces shown in FIG. 6. Each of these junction pieces has a number of stub-like limbs depending on the number of portions 7 to be accommodated by it. For example, at each of the joints 8 in the frames shown in FIGS. 1 and 3 a tee 6A is employed, at each of joints 9 a three-way junction-piece such as 6B is used, and at 10 a simple cross-piece as shown in 6E.

The stub limbs of the junction pieces are firmly secured in the open ends of portions 7 preferably, for simplicity of attachment and dismantling, by simply being formed and sized as firm friction fits inside the tube ends.

In any framework assemblage built up in the manner indicated, at least two parallel members 7 are provided which between them are able to accept one or more light-box modules 11 as shown in FIG. 1.

Figure 5:
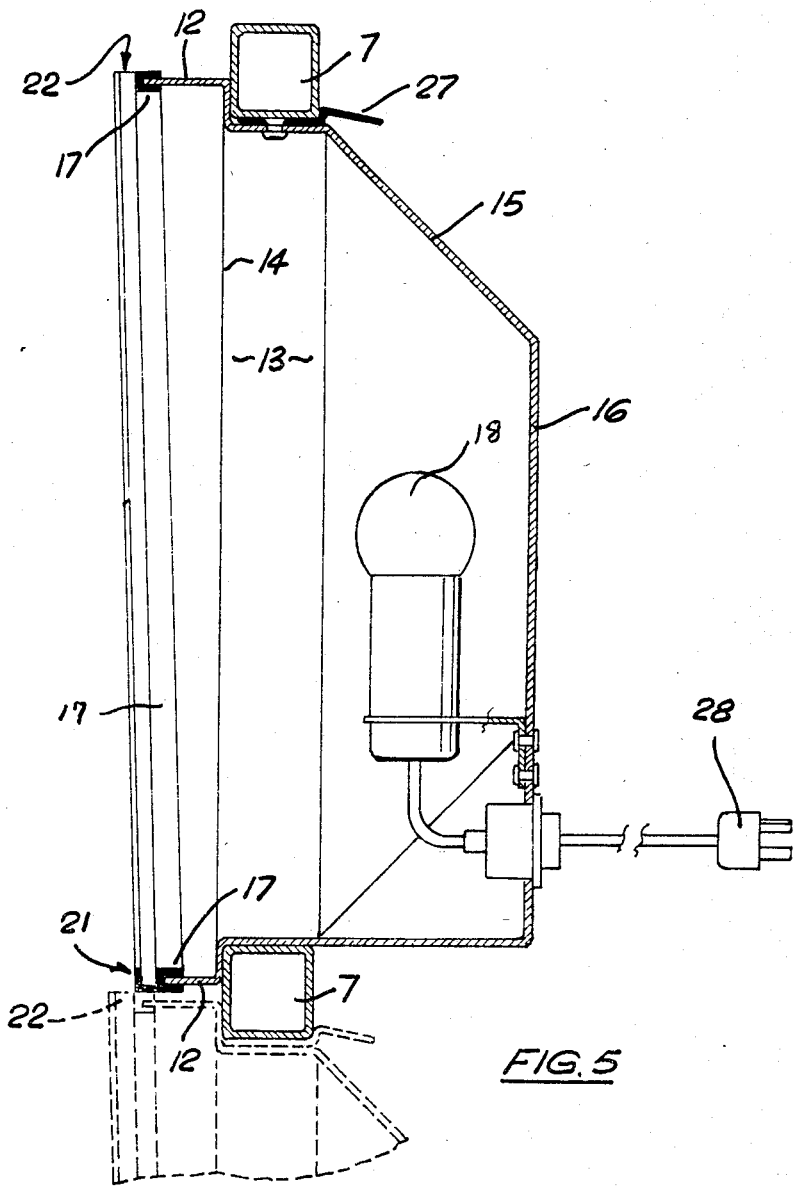
FIG. 5 is a cross-section of the display unit of FIG. 2 taken on line 5—5 shown mounted to a support frame.

With reference to FIGS. 2 and 5, each of the light-box modules comprises a casing having side-walls which on at least three sides of the casing are in two portions 12 and 13 separated by a step 14. Portion 13 is able to enter between an assembled pair of the frame portions 7 with steps 14 resting against those frame portions. Casing wall portions 13 merge into tapered portions 15 and these, in turn, merge into casing back-plate 16. The tapered portions 15 are provided so that two light-boxes may be placed side-by-side with their front faces substantially at right angles.

From this last point concerning light-box placement, it will be appreciated that the frame members 7 may be arranged so that the light-boxes may extend variably either laterally or vertically, or be arrayed in two planes at right-angles or on three or more sides of a cubic or like array.

The open front of each light-box is framed by four members 17, mitred together at their ends. Each of these members has a channel formation to receive the free edges of casing portions 12 and those at the bottom and sides each have transparent keeper flanges 21 providing top openings 22 through which items for display may be descended for retention as the front walls of the light-boxes.

The matters for display consist of a transparency 23 portraying the matter to be displayed, a rear backing plate 24 made of translucent material such as acrylic or frosted glass, and a front support plate 25 made of transparent acrylic, glass or the like.

These three items (23, 24 and 25) can be descended into frame members 17 via top opening 22 by keeper flanges 21 for retention.

Figure 4:
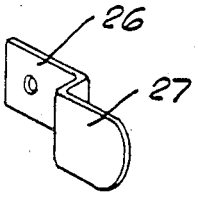
FIG. 4 shows a spring clip used for holding the display unit of FIG. 2 on a support frame.

The light-boxes each carry spring clips shown in more detail in FIG. 4 and comprising a shank 26 which is joined to the light-box by riveting or otherwise, and a latch portion 27 able to engage behind the member 7 to which the light-box is applied in a snap-fitting manner.

Each of the light-boxes is furnished with a light source 18 with conventional fittings and circuiting arrangements therefor and the casing is provided with ventilation holes 28.

For preference one of the light-boxes in a pural array thereof (light-box "A" in FIG. 1 for example) is used as a main box connectable with or including a power source, as indicated at 28, while the other light boxes in the array are connected to box "A" and a conventionally controlled switch means, housed in box "A", whereby the light source of a whole group of boxes or a combination of boxes may be "on" or "off" or illumination of the group or of combinations may be in any selected sequence and at such timing as may be required.

For preference the casing is moulded from a plastics material; and the light box module 11 is assembled from the casing and channel formation members 17 which makes for a simple inexpensive construction. A lamp holder, circuit sockets, clips and the like may be pop rivet fastened to moulded mounting locations.

It is strongly preferred that the module be sized to accept a 30 cm×30 cm transparency. That size enables the frame to receive transparencies made by cutting A3 colour transparencies which may be prepared, for example, by a photocopying process at relatively low cost in comparison with the cost of manufacture of photographic transparencies of a large area.

As shown in FIG. 5 the distance between frame member 17 and step 14 is preferably less at the lower edge 12 than at the upper edge 12 of module 11 so that when the module is mounted in a vertical frame work with a second module contiguous and above the first the lower edge 12 of the upper module does not interfere with insertion or removal of transparencies from the lower module.

It will be understood that the skeletal frame may consist of members of a different cross-section or configuration from that of the example illustrated and may be arranged in any desired manner. The spring clips described in FIG. 4 are highly preferred for mounting light box modules to a frame but other means for mounting may be employed within the scope hereof.

As will be apparent to those skilled in the art from the teaching hereof the invention may be embodied in many forms and all such embodiments are deemed to be within the scope hereof.

I claim:

1. An illuminated display comprising a skeletal support frame an a plurality of light box modules, the skeletal support frame forming a plurality of contiguous, rectangular openings, each opening being of a predetermined size to receive one light box module, the front of the support frame defining an outside vertical surface, each module including a casing, a light source within the casing and means for mounting a transparency in front of the light source, each casing have a first rectangular portion of a larger size than the rectangular opening in the skeletal frame which receives the casing, and a second rectangular portion of smaller size than the opening, the first and second rectangular portions of the casing being contiguous and having a vertical step between them, each casing being removably inserted in an opening in the frame with the step abutting the outside vertical surface of the frame, the first rectangular portion projecting outwardly beyond the vertical surface of the frame and the second portion of the casing fitting within the rectangular opening, releasable means for retaining the module within the frame, the means for mounting the transparency in the module being a keeper flange supported by the projecting first rectangular portion of the casing, the top portion of the keeper flange being open to receive the transparency, the top of the said first rectangular portion of the casing extending outwardly from the step a greater distance that the bottom portion thereby to form an angle between the keeper flange and the step, whereby the top opening of the keeper flange of a first lower module is forward of the bottom edge of the keeper flange of a second upper module which is located contiguous with the top edge of the first module so that a transparency may be inserted and removed from the first module without removing either module from the frame.

2. An illuminated display according to claim 1 wherein the casing of each module is positioned in the frame such that a transparency displayed by one module is substantially contiguous with a transparency displayed by an adjacent module.

3. An illuminated display according to claim 1 wherein one module is mounted in the frame member in contiguous relationship with a first edge of another like module and a third like module is mounted in contiguous relationship with a second edge of the said other module, which second edge is perpendicular to the said first edge.

4. An illuminated display according to claim 1 wherein two modules are mounted in the frame member adjacent each other and wherein the transparencies lie in planes normal to each other.

5. An illuminated display according to claim 1 wherein the transparency mounting means is of a size sufficient to receive a transparency of 30 cm×30 cm.

6. An illuminated display according to claim 1 wherein a plurality of modules are electrically connected with a master module, the master module including electronic control means for switching the light of each module on in a predetermined sequence of combinations.

7. An illuminated display according to claim 1 wherein said light box modules are molded from a plastic material and have inwardly tapering sidewalls located within the frame.

8. An illuminated display according to claim 1 wherein the releasable means is at least one spring clip engagable between the casing and the portion of the frame forming the rectangular opening.

* * * * *